US007244095B2

(12) United States Patent
Hays

(10) Patent No.: US 7,244,095 B2
(45) Date of Patent: Jul. 17, 2007

(54) DUAL PRESSURE EULER STEAM TURBINE

(75) Inventor: Lance G. Hays, Tustin, CA (US)

(73) Assignee: Energent Corporation, Santa Ana, CA (US)

( * ) Notice: Subject to any disclaimer, the term of this patent is extended or adjusted under 35 U.S.C. 154(b) by 0 days.

(21) Appl. No.: 11/013,073

(22) Filed: Dec. 16, 2004

(65) Prior Publication Data

US 2006/0133921 A1 Jun. 22, 2006

(51) Int. Cl.
*F01D 1/06* (2006.01)
*F01D 3/00* (2006.01)

(52) U.S. Cl. ..... 415/84; 415/106; 415/173.1; 415/173.5

(58) Field of Classification Search ..... 415/84, 415/104, 106, 111, 112, 173.1, 173.5, 174.5, 415/199.1, 230
See application file for complete search history.

(56) References Cited

U.S. PATENT DOCUMENTS 1,860,817 A * 5/1932 Peterson ..... 415/104
2,021,078 A * 11/1935 Miller ..... 415/87
3,038,138 A * 6/1962 Hanny ..... 62/192
3,044,837 A * 7/1962 Beaney ..... 384/135
3,083,448 A * 4/1963 Moore ..... 428/636
3,314,647 A * 4/1967 Pavlecka ..... 415/1
3,966,351 A * 6/1976 Sproule ..... 415/110
4,205,942 A * 6/1980 Yokoyama ..... 415/106
4,687,946 A * 8/1987 Jones ..... 290/40 R
4,958,986 A * 9/1990 Boussuges ..... 415/88
6,039,535 A * 3/2000 Kobayashi et al. ..... 415/172.1
6,127,044 A * 10/2000 Yamamoto et al. ..... 428/603

* cited by examiner

*Primary Examiner*—Edward K. Look
*Assistant Examiner*—Nathan Wiehe
(74) *Attorney, Agent, or Firm*—William W. Haefliger

(57) ABSTRACT

A turbine, including a rotor on a shaft, and having in combination stationary nozzles discharging steam at a first pressure or pressures thereby producing impulse forces on the rotor; internal passages in the rotor producing a pressure head increase in the discharged steam, while simultaneously accelerating the steam, the steam discharged to a second pressure lower than the first pressure, producing reaction forces on the rotor; seal means between the stationary nozzles and the rotor, maintaining the pressure difference between the first pressure and the second pressure while minimizing steam leakage past the internal passages, turbine operations producing shaft power.

18 Claims, 8 Drawing Sheets

DUAL PRESSURE EULER STEAM TURBINE

BACKGROUND OF THE INVENTION

One of the most successful technologies applied to industry is the single stage (back pressure) steam turbine. These reliable prime movers are used throughout the chemical and petroleum industries to produce electrical power and to drive pumps and compressors from process steam. Currently over 100,000 units are installed and operating at an average power level of about 250 kW.

Unfortunately, current single stage steam turbines are also one of the largest sources of wasted energy in these industries and others. The average efficiency of single stage, back pressure steam turbines is in the 30-45% range. Another problem commonly encountered with industrial steam applications is structural erosion produced by liquid or solid particles in poor quality steam. If the efficiencies of the current industrial steam turbine population were increased from the current average of 40%, to 80%, steam consumption could be halved (or power output doubled). For the above population this amounts to an energy savings of 467 trillion Btu per year (at 50% capacity factor). This energy savings is the energy equivalent of 74 million barrels of oil per year.

The current "new" industrial steam turbine market is 600 units per year at an average power level of 350 kW, with the same "old" efficiency level of 40%. If the efficiencies of these units were increased to 80%, the energy savings would be 3.9 trillion Btu per year (at 50% capacity factor). This energy savings is the equivalent of 623,000 barrels of oil per year. Clearly, a huge energy savings, and reduction of carbon and $NO_x$ emissions can be achieved if a more efficient, reliable and less costly steam turbine can be made available on a commercial basis.

Another application for steam turbines is the generation of power from high pressure geothermal steam. This technology has been successful for installations where the geothermal flow is flashed to low pressures, the steam separated and extensively scrubbed and cleaned. However, attempts to generate power from the steam from the geothermal wells at higher pressures have been unreliable because of structural erosion by liquid and solid particles.

SUMMARY OF INVENTION

A primary objective of this invention is the provision of a high efficiency, less expensive steam turbine, in the form of a dual pressure Euler steam turbine, which has a higher efficiency than conventional industrial steam turbines.

A further objective is the provision of a steam turbine which is resistant to erosion damage from poor quality steam, such as commonly occurs in industrial applications or geothermal applications.

Another objective is provision of a steam turbine driven electric generator which minimizes required floor space and which requires no alignment during installation.

An added objective is provision of a steam turbine which enables and employs multiple expansion stages with a single rotor.

A yet further objective is provision of a steam reaction turbine in which the axial thrust produced by the pressure drop is minimized.

An additional objective is provision of a steam turbine having no steam leakage, and no contacting seal surfaces.

Another objective is provision of a steam turbine combining significant erosion resistance with variable nozzle vanes which can be used for flow control.

Yet another objective is provision of a self contained electric generating system incorporating the above referenced new steam turbine which can be easily installed to generate power from wasted steam energy.

The new turbine is embodied in a dual Euler turbine, which can be applied to operation with steam to achieve these advantages. The innovations necessary to achieve these and other advantages will be demonstrated by the following description and figures.

These and other objects and advantages of the invention, as well as the details of an illustrative embodiment, will be more fully understood from the following specification and drawings, in which:

DRAWING DESCRIPTION

Figure 4A:
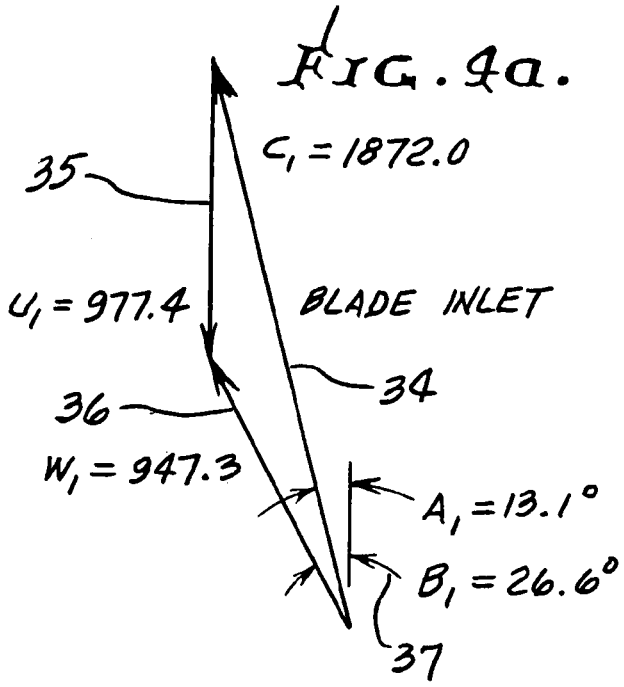
Figure 4B:
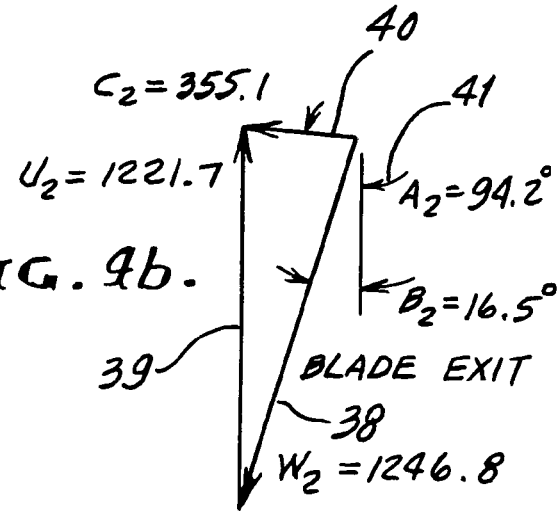
Figure 4C:
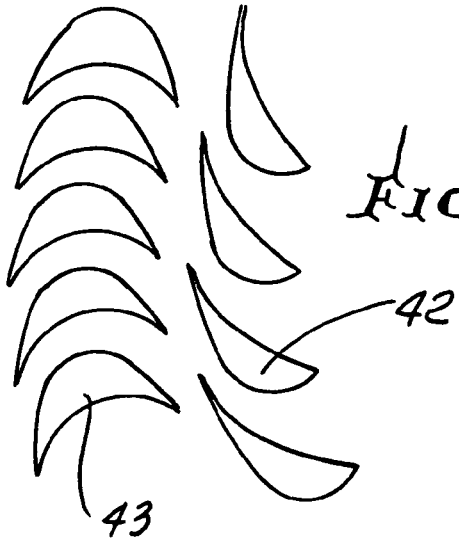
Figure 5:
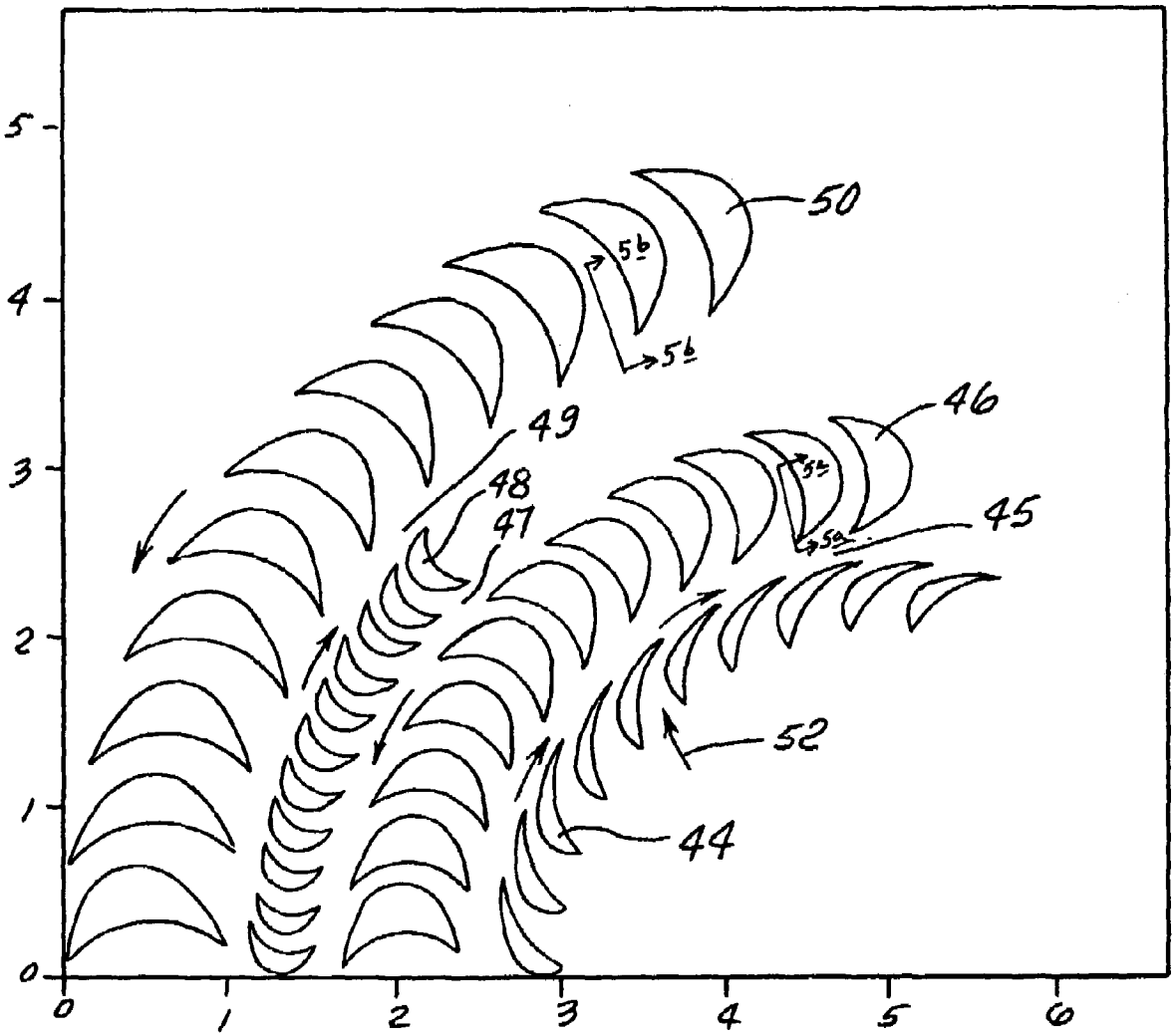
Figure 5A:
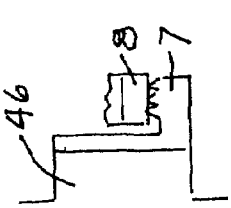
Figure 5B:
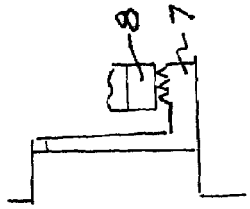
Figure 6:
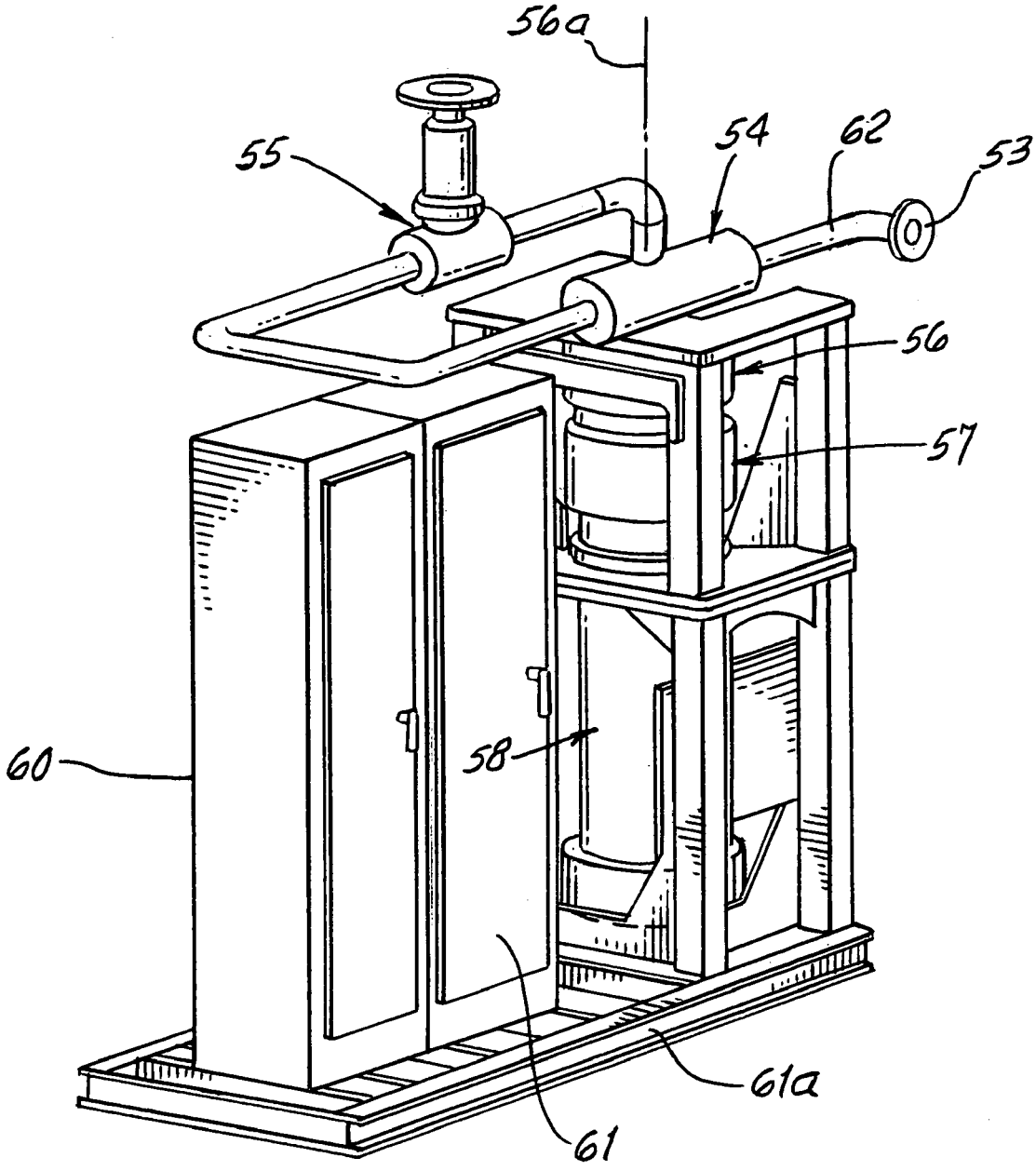
Figure 7:
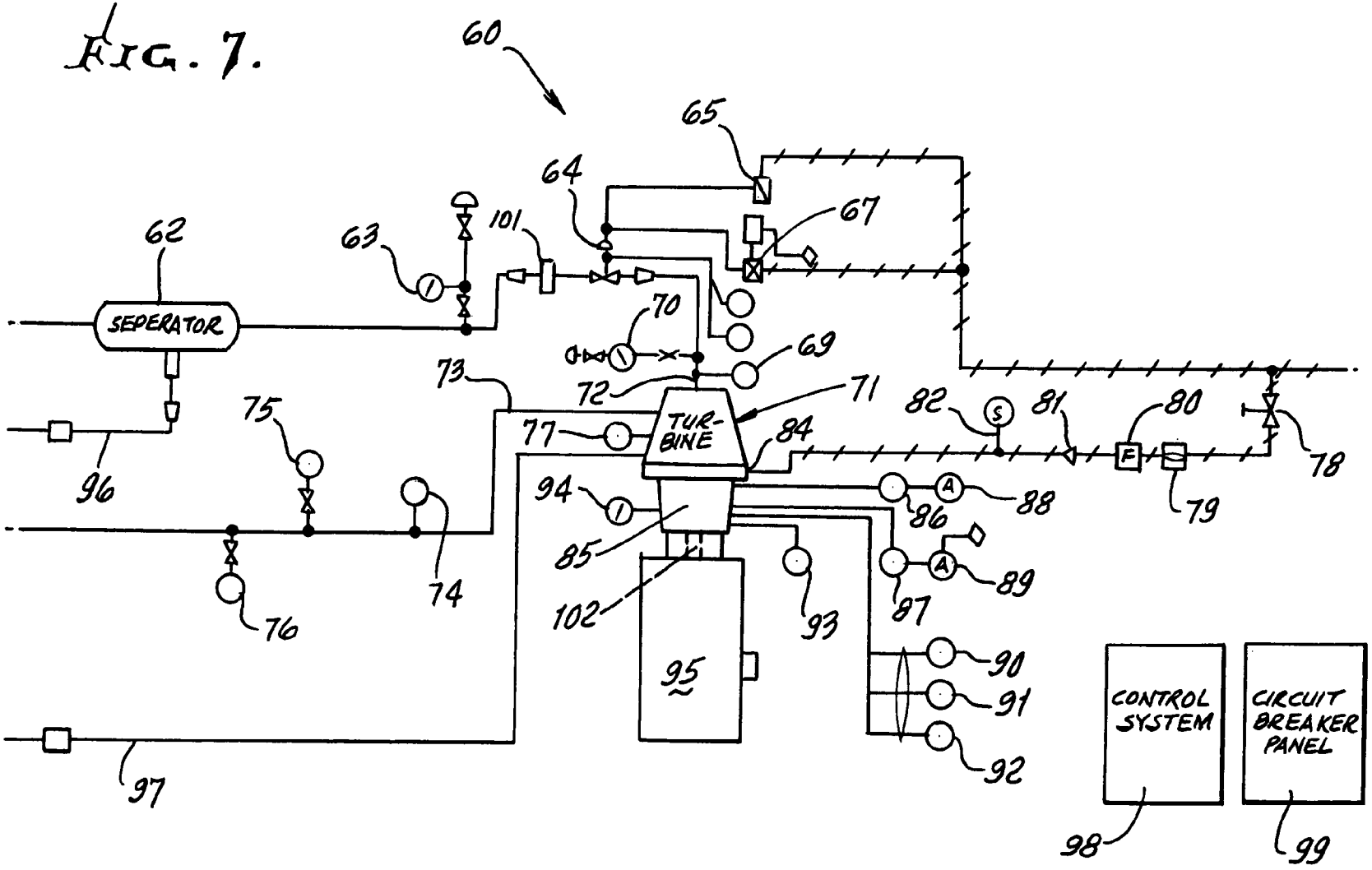

FIGS. 4*a* and 4*b* are velocity diagrams and FIG. 4*c* shows stationary and rotary blades;

FIG. 5 is a partial cross-section through blades of a two-stage, dual pressure Euler turbine;

FIG. 5*a* is a section taken on lines 5*a*-5*a* of FIG. 5;

FIG. 5*b* is a section taken on lines 5*b*-5*b* of FIG. 5;

FIG. 6 is a view showing installation if a dual pressure Euler turbine on a vertical axis, in a power system;

FIG. 7 is a view showing operation of the FIG. 6 system; and

Figure 8:
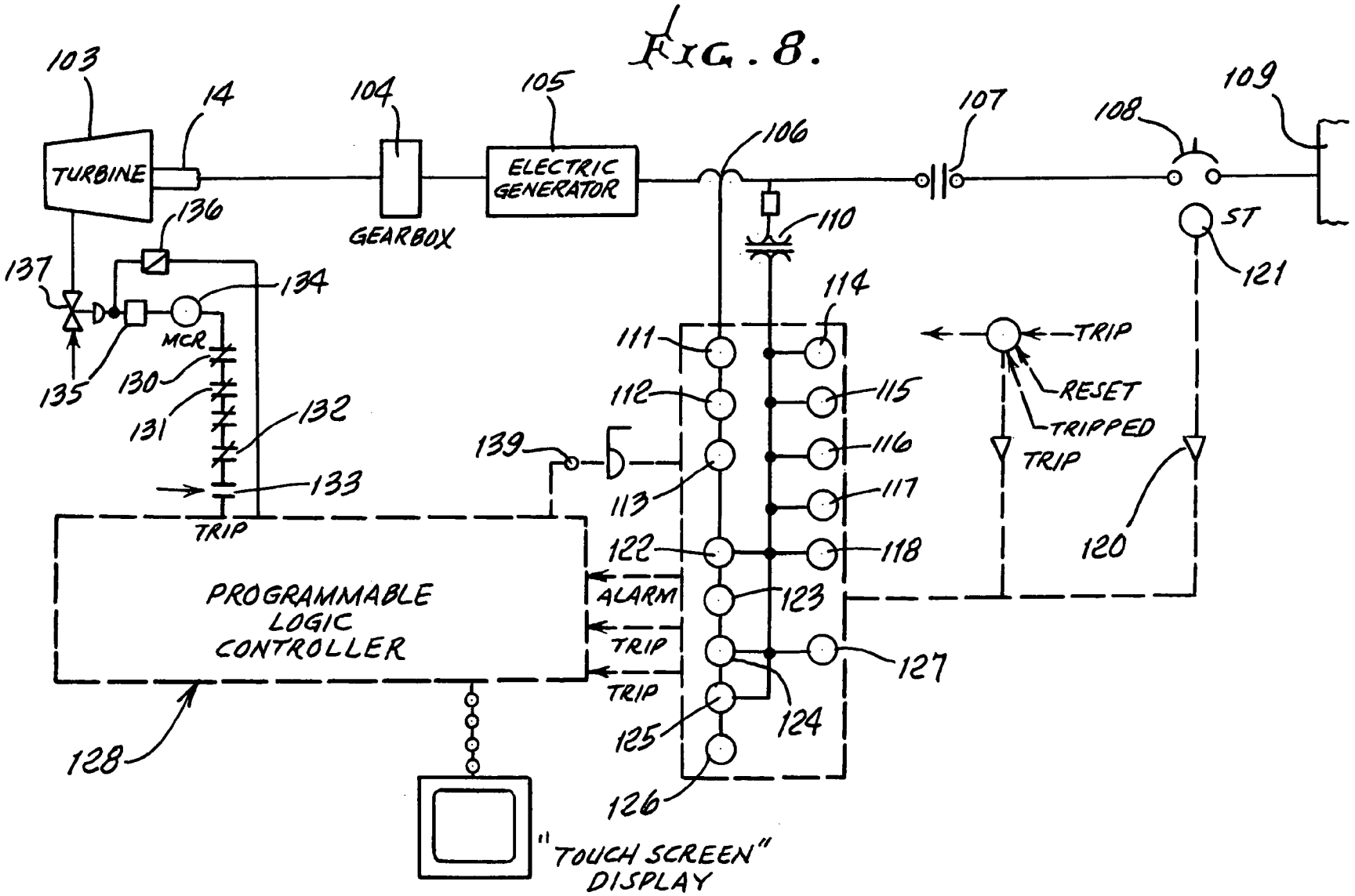

FIG. 8 is a diagram showing an electrical system and control functions of a power system.

DETAILED DESCRIPTION

Figure 1:
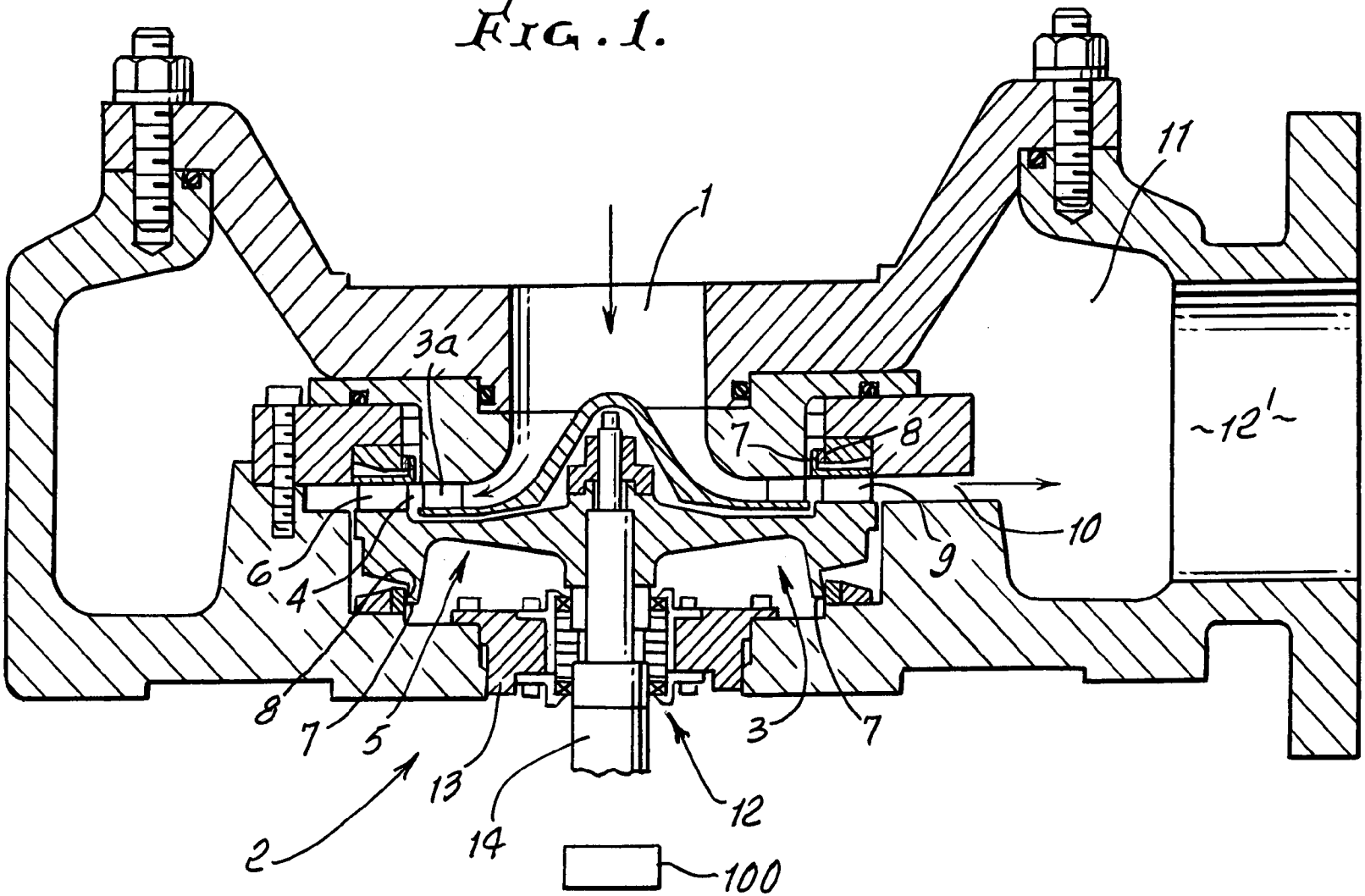
FIG. 1 is a cross-section taken through a dual Euler turbine, for operation with steam.

In the FIG. 1 cross section, a single expansion stage is illustrated. Steam is introduced through a port 1, at the centerline of the turbine assembly 2. The steam is expanded radially outwardly through a nozzle assembly 3, and comprising stationary blades 3*a* which are configured to efficiently accelerate the steam to a high velocity.

The steam at the exit 4, of the nozzles flows in a generally tangential direction to a rotor structure 5, and flows radially outwardly through vanes 6, attached to the rotor structure. Metal projections 7 are carried by the rotor structure, and seal against non-rotating abradable surface or surfaces 8, restricting the amount of flow which could otherwise bypass the passage or passages 9, formed by the rotor blades. See FIGS. 5, 5*a* and 5*b*.

High velocity flow from the nozzles enters the rotor passages, the rotor rotational speed being selected to minimize the relative velocity between the steam and the moving blades and to minimize the absolute value of the velocity of the steam leaving the blades.

Any liquid or solid particles, heavier than the steam, are centrifuged out from the radially extending space 10 between the nozzles and the rotor blades. The residence of uncentrifuged particles is limited to a fraction of a revolution. This is in contrast to radial inflow turbines where solid or liquid particulate matter tries to flow in a direction opposite the centrifugal forces, resulting in trapped particles which continue to impact the moving blades and nozzles causing extensive erosion damage.

Steam leaving the rotating blades flows into the annular diffuser passage, 10, which recovers the absolute leaving velocity as pressure. This enables the pressure at the exit of the moving blades to be lower than the process imposed pressure, increasing the power output. The steam then flows into an annular plenum, 11, and subsequently to exit port 12' of the turbine assembly, where it is returned to the process.

Figure 2:
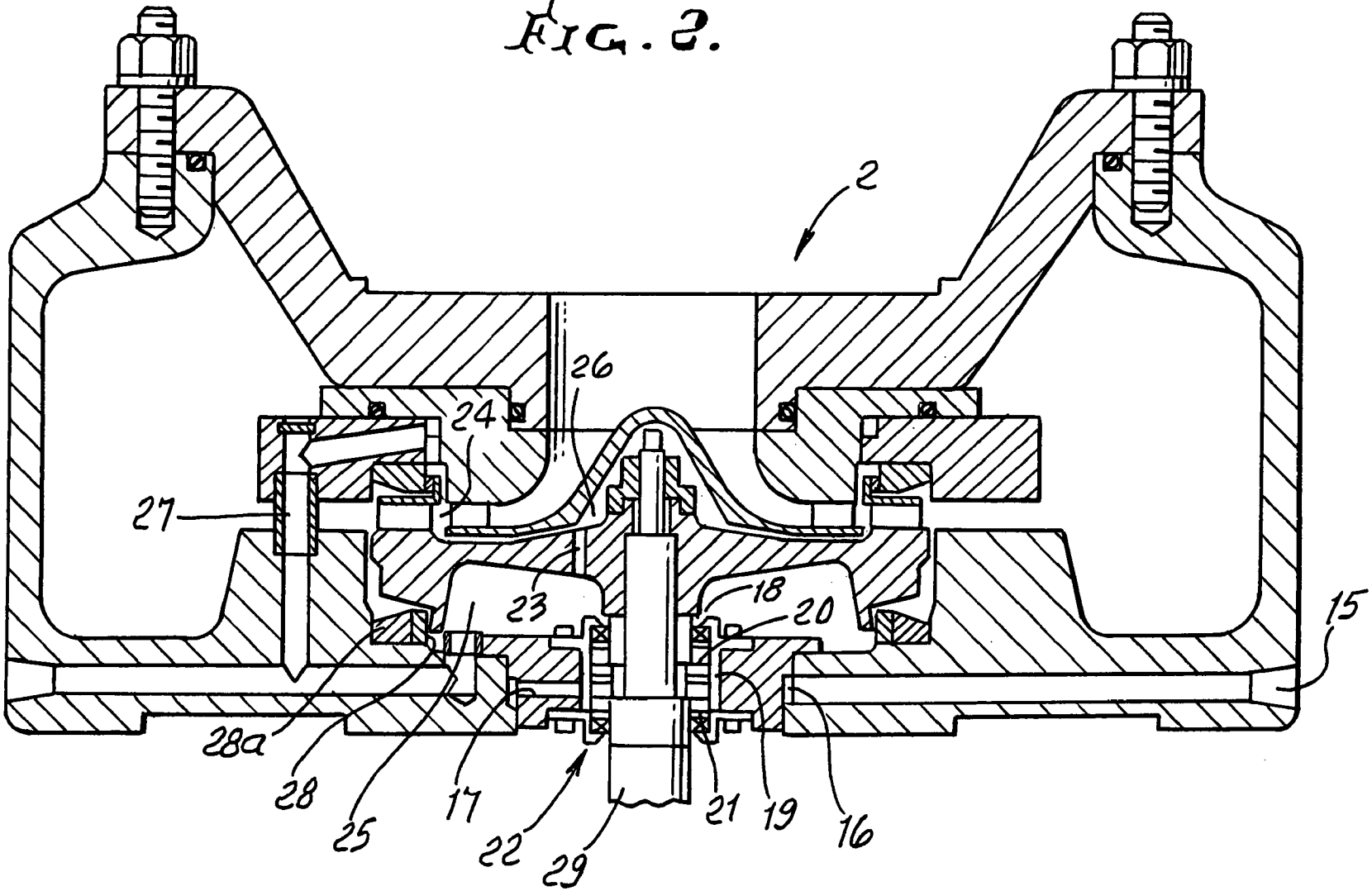
FIG. 2 is a view showing operation of a seal or seal assembly in the FIG. 1 turbine.

A non-contact seal assembly, 12, is provided to reduce the leakage of steam between the stationary surfaces of the casing 13, and the shaft 14, to which the rotor is attached. FIG. 2 shows the action of the seal. Compressed air or another pressurized gas is introduced to the seal through an inlet port 15. The pressurized gas flows to annular space 16, and flows to the seal assembly through transfer holes 17. The pressurized gas is provided at a pressure above the pressure of the steam at the location 18, where the steam is exposed to the seal. The pressurized gas flows to the space 19, outboard of the seal. The centrifugal resistance of the rotating face 20 of the seal reduces the air flow into the steam location. The centrifugal resistance of a second rotating face 21, reduces the flow of the pressurized air into the surroundings 22.

To reduce the imbalance of axial forces on the rotor, both internal and external passages are provided. FIG. 2 shows the placement of passages 23 in the rotor, allowing the steam pressure at the nozzle exit 24, and the steam pressure at the top part 26 of the rotor to communicate with the space 25, on the bottom side of the rotor. In addition, a passage 27, is provided external to the rotor such that the nozzle exit pressure communicates with the bottom side of the rotor. The only force imbalance is due to the pressure drop resulting from the small leakage flow through the seal face 28, between the rotor and casing structure 28*a*. The torque transferred to the rotor shaft 29, is used to drive an electrical or mechanical load, indicated at 100.

Figure 3:
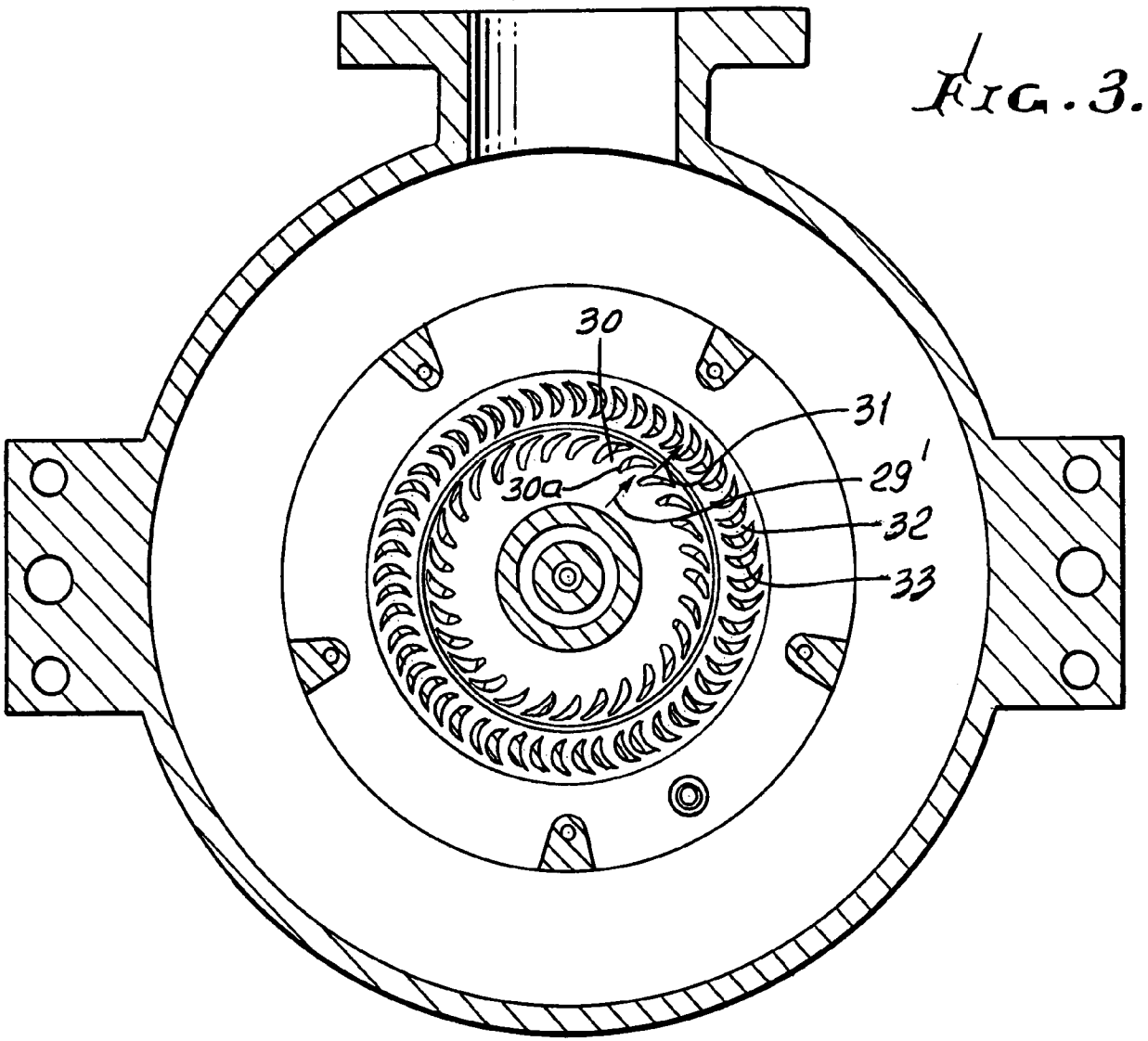
FIG. 3 is a cross-sectional view of the nozzles and rotor blades.

FIG. 3 shows a cross-sectional view of the nozzles and rotor blades. Steam at 29', enters the stationary nozzles 30, in a generally radial direction. The flow is accelerated in the passages formed by the nozzle blades 30*a*. The high velocity flow leaving the nozzles at 31 is directed into the Euler passages 32, formed by the rotating rotor blades 33. The flow head is increased as the steam flows outward caused by the centrifugal forces from the rotating structure. Simultaneously, the flow is accelerated by the decreasing areas of the passages and the lower exhaust pressure, resulting from the seals provided. The steam tangential velocity leaving the blades is typically low, resulting in a high efficiency.

FIG. 4*a* is a typical velocity diagram showing the velocities of the steam and blades for certain blade inlet representative conditions. The steam velocity 34 leaving the nozzles is 1872 ft/s. When combined with the rotor blade velocity 35 at the inlet, a relative entering velocity 36, having a value of 947.3 ft/s results. This gives an entrance angle, 37, of 26.6 degrees. Acceleration of steam, in the blades to the exit conditions shown in FIG. 4*b* gives a relative steam leaving velocity 38, of 1246.8 ft/s. When combined with the blade velocity 39 at the exit, the leaving steam absolute velocity is only 355.1 ft/s and the leaving angle is 94.2 degrees. This gives an absolute leaving tangential velocity of only 26 ft/s. For the conditions of the velocity triangle, an analysis of the mean path flow and losses gives an efficiency of 73% of isentropic power, a substantial gain above current steam turbines. FIG. 4*a* shows stationary and rotating blades 42 and 43.

The dual pressure Euler steam turbine also enables the use of four or more expansions with a single wheel. FIG. 5 is a partial cross section of a typical two-stage dual pressure Euler steam turbine. Steam enters the first stage stationary nozzles 44, at 52. The steam is accelerated in the passages to a high velocity at the nozzle exit area 45. The high velocity steam then enters passages formed by the first stage rotor blades 46. The head is increased in the Euler passage and the steam is accelerated by the passage area and the pressure difference between inlet and outlet 47, which is maintained by a seal 7 of FIG. 1. The entering impulse forces and reaction forces produce torque on the rotor to which the blades are attached as shown by 5 and 6 of FIG. 1.

The steam is further accelerated by a second stage of stationary nozzles, 48. The steam is accelerated to a high velocity at the exits 49, of the second stage nozzles. The steam then enters a second row of blades, 50, also attached to the same rotor. The entering impulse forces and reaction forces again transfer additional torque to the rotor. Additional stages of stationary nozzles and moving blades may be provided, all with a single rotor structure. The result is an efficient, multistage turbine with very low fabrication costs and complexity. For an inlet pressure of 150 psig and an exit pressure of 15 psig and a steam flow rate of 10,000 lb/h, a two stage dual pressure Euler steam turbine typically has an efficiency of 80% using a mean line path analysis and all loss coefficients. This is believed to be the first time any steam turbine of this size has reached an efficiency of 80%.

The dual pressure Euler steam turbine can be arranged on a vertical axis in a power plant system to reduce the required space for installation. FIG. 6 shows the arrangement. Steam enters the power system through an inlet, such as at flange 53. The steam flows through duct 62 to a separator 54, to remove solid or liquid contaminants. The flow of the steam is controlled by a combined throttle and trip valve 55. The steam then flows into the dual pressure Euler steam turbine 56, which is mounted with a vertical axis 56*a*. The shaft 14 (from FIG. 1) drives gearing in a gearbox 57, to reduce the turbine speed to the speed of the generator 58. The generator converts the shaft torque to electric power which is connected to circuitry in the electric switchgear cabinet 61. A support stand 61*a* is provided to absorb any steam piping forces.

A control system 60 is provided as seen in FIG. 7 with a programmable logic controller to control the operation of the power system. Measurement of the pressure of the steam leaving the steam turbine 71, is accomplished with a pressure transmitter. In response to steam demand, the pressure drops or increases for the same steam flow. The control system senses any change in pressure, and actuates the control valve to change the steam flow in a manner to keep the outlet pressure constant.

The operation of the power system is shown in FIG. 7. Steam flow enters the system through a separator 62, which removes solid or liquid particulate matter. A pressure gauge 63, is provided for visual indication of the steam pressure. The steam flows through a strainer 101, to remove any debris from the inlet piping or separator welds. The steam flow enters a combined trip and control (t&c) valve 64. The t&c valve has two functions: control of the steam flow rate and shutoff of the steam flow in the event of various malfunctions in the power system.

The control of steam flow rate is accomplished by a current-to-pressure converter 65, which converts electrical signals from the control system 98, to air pressure to actuate the t&c valve diaphragm.

The t&c valve is closed by a signal from the control system to a solenoid valve 67, which opens instantaneously, exhausting the air which had been holding the t&c valve open. When the air is exhausted a spring closes the t&c valve instantaneously.

The steam flow enters the dual pressure Euler steam turbine 71, at an inlet port, 72. After imparting torque to the rotor 5 as seen in FIG. 1, the steam leaves the turbine at 72 in FIG. 7. A pressure gauge 70, and a temperature transducer 69, are provided at the inlet to the turbine. The pressure gauge is provided to enable visual determination of the inlet steam pressure. The temperature transducer sends a signal to the control system, which is used to determine if a safe value of steam temperature exists. If the steam temperature is too high the control system actuates the solenoid valve to close the t&c valve.

A temperature transducer 74, is provided in the steam exhaust line 73, to provide a signal to the control system. The temperature reading is checked against the pressure reading of a pressure transmitter 76, to ensure that the pressure reading is correct.

The pressure transmitter 76, measures the pressure of the steam leaving the turbine and transmits its value to the control system. The control system has been set to maintain a value of the pressure which is required by any uses of the steam outside of the power system. If pressure drops, it is an indication that the device using steam, such as a steam absorption chiller or water heater, requires more steam than the power system is providing. The control system sends a signal to open the t&c valve to admit more steam until the pressure is at the required value. Conversely, if the pressure increases above the set value, it is an indication that steam demand is less than is being provided. The control system sends a signal to close the t&c valve until the pressure is at the required value.

If the pressure exceeds a safe value for the outside steam system, the control system closes the t&c valve completely, using the trip solenoid.

A pressure switch 75, is also provided to close the t&c valve completely if the pressure exceeds a safe value. The pressure switch is a backup to the pressure transmitter, in the event the pressure transmitter does not measure the pressure correctly or fails.

To seal the turbine shaft 14 of FIG. 1, pressurized gas is provided to the casing 84, and introduced to the turbine seal 12 of FIG. 1. In this system air from the plant air is reduced in pressure by a regulator 78 seen in FIG. 7. The air flows through a flow indicator 79, a filter 80, and a check valve 81. A pressure switch 82, is provided which closes a relay to close the t&c valve in the event the seal air pressure is too low to prevent steam leakage.

The turbine shaft provides torque to gearing in a gearbox 85, which reduces the speed of the turbine shaft, for example 28,000 rpm in this case, to a speed of 1,800 rpm for the gearbox output shaft 102. The gearbox has a speed measurement device 87, which sends a signal to an amplifier 89, which sends a corresponding indication to the control system. The amplifier output is also connected to a relay which closes the t&c valve if the turbine speed is above a safe level. Another speed pickup signal at 86, is supplied to another amplifier 88, which is also connected to the control system, giving a backup speed signal if one of the two indicators or amplifiers fails.

A vibration probe 93, is also applied to the gearbox to determine if the vibration is within safe limits. A temperature indicator 94, is supplied to indicate if the bearing temperature is within safe limits. Both instruments provide a signal or signals to the control system which will indicate an alarm if the parameter is too high and which will close the t&c valve if an unsafe condition exists.

The lubrication oil pressure is measured by pressure transmitters 91 and 92, to determine if the temperature is within normal limits. The temperatures are transmitted to the control system which activates an alarm if the pressure is too low and closes the t&c valve if the oil pressures are at an unsafe level.

The temperature of the lube oil for the rotating elements is measured by a temperature instrument 90. The signal is transmitted to the control system which activates an alarm if the temperature is too high and closes the t&c valve if the lube oil temperature is at an unsafe level.

The gearbox shaft rotates the rotor of the electric generator 95, producing electric power. The power is transmitted to the circuit breaker panel 99, from where it is supplied to an electrical load.

Water drains from the separator 62, and from the turbine 71, are piped at 96 and 97 to associated steam traps, which permit water to drain but which prevent steam from leaking.

To enable startup a temperature instrument 77, is provided on the turbine casing. The turbine is warmed up with steam before opening the t&c valve. The temperature instrument signal is transmitted to the control system. The control system prevents opening the t&c valve until the temperature instrument indicates a safe turbine temperature has been reached.

FIG. 8 shows the electrical system and control functions for the power system incorporating a dual pressure Euler steam turbine.

When the steam is causing the shaft 14 of FIG. 1, of the turbine 103, to rotate, the shaft rotates the rotor of the electric generator 105, through a gearbox 104. The electric current from the generator is conducted through current transformers, 106, to generate an electrical signal which is proportional to the current. The voltage of the electric current generated is transformed by potential transformers 110, to a signal which is proportional to the voltage. The current signal and voltage signals are connected to a multifunction digital relay which contains several measuring devices and relays.

During normal operation the electric current flows through a contactor 107, and a shunt trip 108, to a motor control center panel 109.

The multifunction digital relay senses over current 111, instantaneous over current 112, time-over current 113, negative sequence over voltage 114, under voltage 115, over voltage 116, underfrequency 117, and over frequency 118. If any of these parameters exceeds the safe limits, the multifunction digital relay sends a signal to the master control relay 134, which closes the t&c valve 137, which stops the steam flow to the turbine.

In addition the multifunction digital relay sends a signal to a latching lockout relay 119 and 120, which open the contactor 107. The multifunction digital relay also sends a signal to a shunt trip 121, which opens the intertie circuit breaker, 108. These actions completely isolate the power system from the steam and electrical loads, placing it in a safe condition.

The power 122, energy 123, reactive power 124, power factor 125, volts 127, and current 126 are measured and the signals sent via a data link 139, to the programmable logic controller (PLC) 128, which is a part of the control system. See also circuitry at 130-133 between 128 and 134, and pressure control 132.

The electrical and other instrumentation parameters of FIG. 7, are displayed by the PLC on a "touch screen" display. The touch screen display has "touch buttons" on the screen which can be manipulated to change the power system settings and/or manually adjust the parameters, such as the opening of the t&c valve 137, through the current to pressure converter 136.

The PLC is programmed to perform automatic functions such as determining when the turbine casing is hot enough to start the system, determining when the lube oil pressure is high enough to start the system, automatically opening the t&c valve at a controlled rate until the desired turbine speed is reached, automatically closing the contactor when the proper speed is reached, automatically opening the t&c valve further until the set value for the steam exhaust pressure transmitter 76 of FIG. 7, is reached, and automatically adjusting the t&c valve to limit the power generated to a safe value.

The dual pressure Euler steam turbine is a distinctly new type of steam turbine. Provision of an intermediate expansion pressure results in a turbine having impulse forces and reaction forces with internal head rise. This results in higher efficiency than is characteristic of existing steam turbines. A dual pressure Euler steam turbine and power system provides several advances relative to conventional steam turbines as follows:

1. Use of a low radial velocity and nozzles for expansions, instead of the use of high velocities and a multiplicity of blades, means that high efficiencies can be realized in the high pressure-low flow regime.

2. The dual pressure Euler steam turbine provides two stages of expansion with a single rotor instead of the usual one stage with one rotor. This enables a greater head difference to be used efficiently for the turbine compared to conventional turbomachninery. The efficiency is higher than other steam turbines in this flow regime.

3. The dual pressure Euler steam turbine is a pure radial flow machine. There is no flow induced thrust in the axial direction. This reduces the losses and unreliability associated with thrust bearings, which are required to support the axial forces resulting in conventional turbomachinery from axial impulse forces or from axial forces resulting from reaction.

4. Flow in the radial outward direction means any liquids produced during the expansion or any solids in the flow will be ejected without causing erosion of the first nozzle.

5.The annular diffuser at the exit is a natural consequence of the geometry and has a greater efficiency than a diffuser for either axial flow or radial inflow machinery.

6. A compact, complete power system is enabled by the vertical shaft arrangement. This reduces the installation space required and results in a minimum installation costs in existing equipment rooms having steam piping.

I claim:

1. A turbine, including a rotor on a shaft having an axis, and having in combination:

a) stationary nozzles discharging steam at a first pressure or pressures thereby producing impulse forces on said rotor, b) the rotor having blades forming internal passages producing a pressure head increase in the discharged steam, while simultaneously accelerating the steam, the steam discharged to a second pressure lower than the first pressure, producing reaction forces on the rotor, c) seal means between the stationary nozzles and the rotor, maintaining the pressure difference between the first pressure and the second pressure while minimizing steam leakage past the internal passages, said seal means carried by the rotor and oriented in a radial direction relative to said axis to seal against non-rotating nozzle surface or surfaces to restrict steam flow that would otherwise bypass said passages formed by the rotor blades, d) turbine operation producing shaft power, e) there being passages in the rotor configured to centrifuge liquid and/or solid particles or the steam directionally away from space between the nozzles and passages, f) certain of said seal means being provided at the same diametric locations on opposite sides of the rotor to produce a force balance on the rotor, g) there being holes provided at locations radially inward from said passages, to enable steam from one side of the rotor to translate to the other side of the rotor, to produce a balanced force on the rotor, h) ducting to flow compressed gas to said seal means to provide gas pressure at the seal means to block steam leakage, i) said seal means including projections oriented to seal against non-rotating surfaces which are abradable, j) said projections being carried by the rotor and being metallic, and said passages being formed by the rotor blades, k) and whereby radial outflow from said passages is produced to increase pressure, thereby reducing frictional losses, when exit pressure is lower than inlet pressure, l) each said rotor blade, in cross-section, having a surface with a relatively reduced curvature range facing initial convergent extent of the passage proceeding from the passage inlet, causing an increase in fluid pressure above inlet pressure, said surface having a maximum curvature range facing subsequent convergent extent of the passage following said reduced curvature extent, and characterized in that flow pressure in the passage increases to a maximum value greater than said inlet pressure and then decreases to a pressure less than said inlet pressure.

2. A turbine, including a rotor on a shaft having an axis, and having in combination:

a) stationary nozzles discharging steam at a first pressure or pressures thereby producing impulse forces on said rotor, b) the rotor having blades forming internal passages producing a pressure head increase in the discharged steam, while simultaneously accelerating the steam, the steam discharged to a second pressure lower than the first pressure, producing reaction forces on the rotor, c) seal means between the stationary nozzles and the rotor, maintaining the pressure difference between the first pressure and the second pressure while minimizing steam leakage past the internal passages, said seal means carried by the rotor and oriented in a radial direction relative to said axis to seal against non-rotating nozzle surface or surfaces to restrict steam flow that would otherwise bypass said passages formed by the rotor blades, d) turbine operation producing shaft power, e) and including passages in the rotor between the blades configured to centrifuge liquid and/or solid particles in the steam directionally away from passage inlets, f) each said rotor blade, in cross section, having a surface with a relatively reduced curvature range facing initial convergent extent of the passage proceeding from the passage inlet, causing an increase in fluid pressure above inlet pressure, said surface having a maximum curvature range facing subsequent convergent extent of the passage following said reduced curvature extent, and characterized in that flow pressure in the passage increases to a maximum value greater than said inlet pressure and then decreases to a pressure less than said inlet pressure.

3. The combination of claim 2 wherein the rotor consists essentially of titanium alloy for erosion resistance.

4. The combination of 2 wherein certain of said seal means are provided at the same diametric location on opposite sides of the rotor to produce a force balance on the rotor.

5. The combination of claim 2 wherein holes are provided at locations radially inward from said passages, to enable steam from one side of the rotor to translate to the other side of the rotor, to produce a balance force on the rotor.

6. The combination of claim 2 where passages are provided radially outwardly of the rotor to enable steam flow from one side to the other side of the rotor to produce a force balance on the rotor.

7. The combination of claim 2 having a shaft seal characterized in that pressurized gas provides a means to prevent leakage of steam to the surroundings and wherein non-contact structural faces providing centrifugal forces are used to reduce pressurized gas leakage into the steam.

8. The combination of 2 in which additional rows of stationary nozzles, rotor passages and seal means are provided on the same rotor and oriented in radially outward directions to enable additional power producing steam expansions.

9. The combination of claim 2 wherein the turbine shaft drives gearing which drives an electric generator at synchronous speed to produce electric power from the steam energy.

10. The combination of claim 9 wherein control means and electrical means are provided to produce a complete, automated and self-regulated system to produce electric power from steam energy and to enable ease of installation.

11. The combination of claim 9 wherein the rotor shaft, gearing shaft and generator shaft are vertically oriented to enable a compact assembly.

12. The combination of claim 2 wherein the turbine shaft directly drives a high speed electric generator at a speed above synchronous speed producing electric power from the steam energy.

13. The combination of claim 2 wherein the turbine shaft drives a pump.

14. The combination of claim 2 wherein the turbine shaft drives a compressor.

15. The combination of claim 2 wherein control means and electrical means are provided to produce a complete, automated and self-regulated system to produce electric power from steam energy and to enable ease of installation.

16. The combination of claim 2 wherein g) the turbine shaft directly drives a high speed electric generator at a speed above synchronous speed producing electric power from the steam energy, h) and wherein the rotor shaft and the electric generator shaft are vertically oriented to enable a compact assembly.

17. The combination of claim 2 including ducting to flow compressed gas to said seal means to provide gas pressure counteracting steam pressure at the seal means to block steam leakage.

18. The combination of 2 wherein said seal means includes projections oriented to seal against said nozzle surfaces which are abradable.

* * * * *